United States Patent [19]

Guidez et al.

[11] 4,219,385

[45] Aug. 26, 1980

[54] CIRCULATING PUMPS OF A LIQUID METAL, GENERALLY SODIUM, ENSURING THE COOLING OF THE CORE OF A FAST NEUTRON REACTOR

[75] Inventors: Joël Guidez, Aix en Provence; Maurice Pradel, Grenoble, both of France

[73] Assignee: Commissariat a l'Energie Atomique, France

[21] Appl. No.: 912,840

[22] Filed: Jun. 5, 1978

[30] Foreign Application Priority Data

Jun. 17, 1977 [FR] France ..... 77 18608

[51] Int. Cl.[2] ..... G21C 15/00

[52] U.S. Cl. ..... 176/40; 176/65; 176/87

[58] Field of Search ..... 176/62–63, 176/65, 40, 87

[56] References Cited

U.S. PATENT DOCUMENTS

| | | | |
|---|---|---|---|
| 3,185,631 | 5/1965 | Long et al. | 176/65 |
| 3,715,270 | 2/1973 | Jackson | 176/65 |
| 3,937,653 | 2/1976 | Leheu | 176/65 |
| 3,992,256 | 11/1976 | Lleres et al. | 176/62 |
| 4,033,814 | 7/1977 | Bregeon et al. | 176/62 |
| 4,056,439 | 11/1977 | Robin | 176/65 |

FOREIGN PATENT DOCUMENTS

| | | | |
|---|---|---|---|
| 1019622 | 2/1966 | United Kingdom | 176/65 |

*Primary Examiner*—Harvey E. Behrend
*Attorney, Agent, or Firm*—Thomas J. Greer, Jr.

[57] ABSTRACT

A circulating pump, particularly for the liquid cooling metal of the core of a fast neutron reactor, comprising a non-removable assembly permanently disposed in the vessel containing the liquid metal, constituted by a suction channel, a diffuser and at least one delivery pipe, wherein the non-removable assembly is suspended on a supporting structure which is immobilized relative to the core.

2 Claims, 2 Drawing Figures

Figure 1:
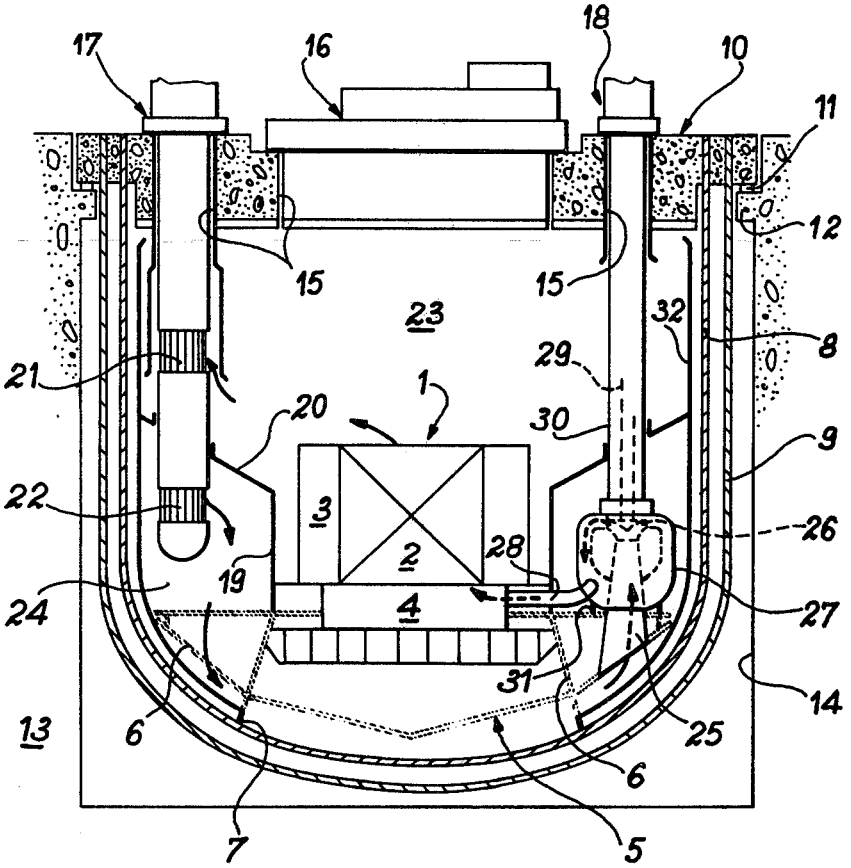

CIRCULATING PUMPS OF A LIQUID METAL, GENERALLY SODIUM, ENSURING THE COOLING OF THE CORE OF A FAST NEUTRON REACTOR

The present invention relates to an improvement to the circulating pumps of a liquid metal, generally sodium, ensuring the cooling of the core of a fast neutron reactor.

It is known that in reactors of this type the core or active part formed by the juxtapositioning of fissile and fertile assemblies is submerged in an appropriate volume of liquid sodium which cools said assemblies, said volume being contained in a metal vessel, called the main vessel, which is open in its upper part and is suspended beneath a concrete plate or slab sealing the upper part of a protective caisson with thick walls and also made from concrete, defining the reactor envelope. The core is itself contained in the main vessel within an inner vessel mounted in the first and which normally rests on a transverse support which itself bears by means of a covering on the lateral ring or base of the main vessel. In operation, the liquid sodium is continuously circulated in such a way that it passes through the support and then the assemblies of the core in an upward vertical direction. On contact with said assemblies the sodium is heated and is then collected above the core in the inner vessel. It is then passed towards intake openings of a series of primary exchangers where it gives of its calories to a secondary fluid passing through the same exchangers. On leaving the latter, the cooled sodium is sucked up by pumps which return it beneath the core support for a further passage through the latter.

In the most modern conventional reactors and in particular the Phenix reactor which is at present in operation in France, the so-called integrated solution is adopted, which corresponds to the installation of the exchangers and pumps within the caisson of the main vessel of the reactor. These pumps and exchangers are disposed with their axis vertical and are preferably regularly and alternately distributed about the common axis of the main vessel and the reactor core contained in the latter. The intake openings of the exchangers are provided in the part of the latter which penetrates the inner vessel, but which is located above an inclined lateral projection provided in the wall of said vessel, whilst their outlet openings are disposed beneath said projection in the space between the main vessel and the inner vessel. The cold sodium passing out of these openings is distributed throughout this space, then being taken up by circulating pumps which return it beneath to support. As a variant, the exchangers and pumps are directly associated, said exchangers being disposed in an annular manner above each of the pumps and around the drive shaft thereof. In all cases, the pumps suck in the cold sodium through a suction channel, generally disposed in the axis of the pump, the centrifugal wheel of the pump which is mounted at the upper end of this channel returning the pressurized sodium into a fixed diffuser having at least one pipe for delivering the sodium to the core support means.

In conventional manner, the centrifugal wheel of each pump is driven by a vertical shaft controlled in rotation by a motor located at its opposite end, externally of the reactor caisson after traversing the slab or plate, said shaft being guided in the main vessel by hydrostatic bearings. In conventional manner, the shaft, bearings and centrifugal wheel of each pump constitute a removable assembly which can be withdrawn from the main vessel through a passage opening of appropriate dimensions made in the slab. However, the suction channel, diffuser and delivery pipe or pipes at the outlet from the centrifugal wheel form a fixed and nonremovable assembly which permanently remains within the vessel.

In the presently known solutions, this non-removable assembly rests by means of slide blocks or the like on a fixed supporting structure, generally constituted by the covering of the support which carries the core and inner vessel. However, in a construction of this type, in order to limit cavitation risks, it would appear desirable to on the one hand design the pumps with a direct suction intake at the base of the collector collecting the cold liquid sodium at the outlet from the exchangers and on the other to increase the axial sinking of the wheel within the main vessel in the diffuser and suction channel. From this standpoint, the supporting structure on which rests the assembly formed by the diffuser and channel may constitute an obstacle, on the one hand to the sinking of the centrifugal wheel leading to cavitation risks, and on the other to the flow of sodium between the outlet of the exchangers and the intake of the channel, which leads to asymmetries in the flow at the pump intake.

The present invention relates to an improvement which obviates these disadvantages.

To this end, the pump is characterised in that the non-removable assembly is suspended on a supporting structure which is immobilised relative to the core.

According to a preferred embodiment of the invention, the supporting structure comprises at least two curved beams fixed by one of their ends to the supporting structure and carrying at the other end suspension members connected to the nonremovable assembly.

Advatageously, the suspension members comprise parallel and separate thin metallic sheets or plates.

As a result of the above dispositions, it is possible on the one hand to eliminate an obstacle to the sodium flow between the outlet of the exchangers and the intake of the suction channels associated with each of the wheels of the pumps and on the other to chock these wheels at a height such that the Net Section Pressure Head is increased, this corresponding to the minimum pressure required at the intake to prevent cavitation. Moreover, the use of thin metal sheets for forming the suspension members of the non-removable assembly of each pump makes it possible to ensure a non-rigid connection between the beams of the supporting structure and said non-removable assembly, whilst the stability of said assembly is ensured by the sodium delivery pipes which connect the diffuser to the reactor support.

Other features of a circulating pump constructed according to the invention will be gathered from the following description relative to an illustrative and non-limitative embodiment and with reference to the attached drawings, wherein show:

FIG. 1 a general diagrammatic view in axial section of a fast neutron reactor using a circulating pump whose non-removable assembly rests on the core supporting covering in accordance with a conventional disposition.

Figure 2:
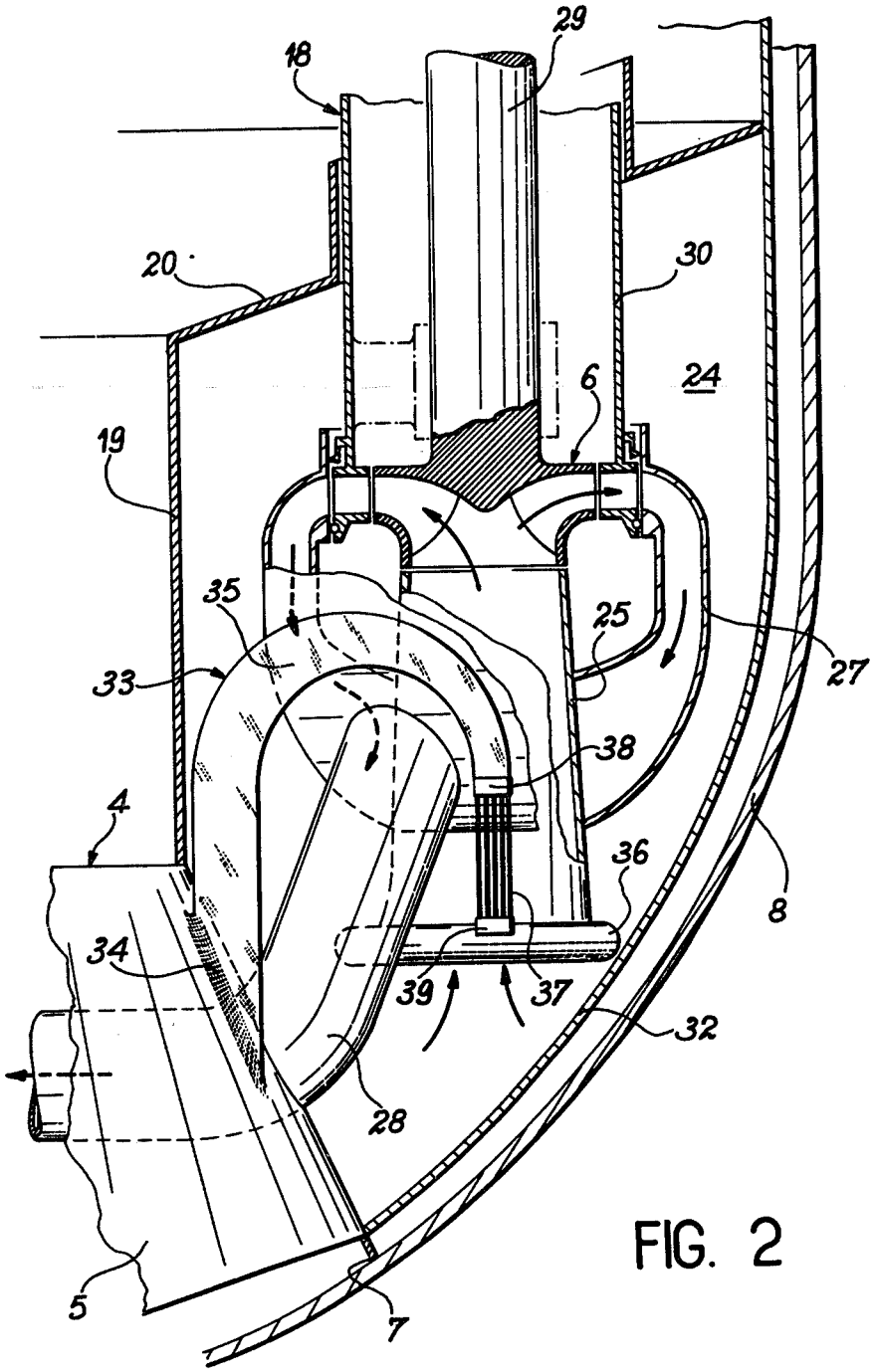

FIG. 2 a detailed view in axial section and on a larger scale of the non-removable assembly of an improved pump according to the present invention.

In FIG. 1, the reference numeral 1 designates the core of a fast neutron reactor which according to the prior art comprises an active part 2 in the centre of the core surrounded by a lateral breeding blanket 3. Core 1 rests on a rigid support 4 supported by a covering 5 formed by stiffeners 6, whereby in turn said covering bears at 7 against the inner surface or base of a vessel 8 surrounding core 1. Vessel 8, called the main vessel, of cylindrical configuration with a vertical axis contains an appropriate volume of a liquid metal, generally sodium in which is submerged the core, whereby said sodium permits in per se known manner the extraction of the calories given off by the fission reaction. This vessel is externally surrounded by a second vessel 9, called the safety vessel, whereby the two vessels 8 and 9 are suspended by their upper ends beneath a sealing slab 10 having a thick concrete wall, which extends transversely and rests by means of supporting members 11 on a circular shoulder 12 provided in a concrete caisson 13, forming the protective envelope. Caisson 13 defines with the sealing slab 10 a cavity 14 within which are disposed the vessels 8 and 9 and the volume of liquid sodium contained in vessel 8. Sealing slab 10 has a series of passage openings 15 permitting on the one hand the fitting within said slab above and vertical to the core a system of rotary plugs giving access to the core for handling the nuclear fuel and on the other hand heat exchangers 17 and circulating pumps 18, said exchangers and pumps being appropriately distributed about the core axis in vessel 8, being submerged within the latter in the liquid sodium volume contained therein. Core 1 is surrounded in vessel 8 by a second vessel 19, called the inner vessel, having a cylindrical wall and carried by the support, whilst being extended at its upper open end by an inclined projection 20, which extends transversely virtually up to a baffle 32 which duplicates the inner wall of vessel 8 in order to ensure the cooling of the latter in per se known manner. This projection, which thus separates the inner volume of the vessel into two regions is traversed by exchangers 17 and pumps 18. Exchangers 17 have intake ports 21 located above projection 20 and outlet ports 22 located beneath the latter in such a way that the sodium collected within the vessel 19 in region 23 at the outlet from the core and being in particular heated in the latter penetrates the exchangers via the ports 21 then, after an exchange of calories with a suitable secondary fluid, is returned, after cooling, through ports 22 into the space 24 located beneath the projection 20. The cooled sodium is then sucked up by the frustum-shaped channels 25, associated with each of the pumps 18, whereby for each pump this sodium is delivered by means of a centrifugal wheel 26 into a diffuser 27 and is then returned by one or more pipes 28 towards the inside of support 4 for a further passage in an upward vertical direction in the core. The centrifugal wheel 26 is driven by means of a vertical shaft 29 surrounded by an envelope 30, which is indicated in diagrammatic form and externally defines the pump body, whereby the not shown control motor is mounted outside the actual reactor above the protective slab.

As a result of these dispositions wheel 26, its drive shaft 29 and its envelope 30 constitute a removable assembly which, for each pump, can be separately removed from the main vessel 8 via opening 15 which is provided in slab 10, whilst suction channel 25, diffuser 27 and the delivery pipes 28 connected to said diffuser and to the support 4 constitute a non-removable fixed assembly, which permanently remains within the vessel. According to a conventional arrangement, this non-removable assembly rests on a lateral extension of covering 5 by means of sliding blocks 31, indicated diagrammatically in FIG. 1, which are only able to tolerate the expansion differences liable to occur between said non-removable assembly and the covering during the operation of the reactor.

In order to limit the risks of cavitation at the pump intake and in particular to ensure a maximum lowering of the position of the centrifugal wheel relative to the lower end of the suction channel, according to the present invention, improvements are obtained by mounting each of the pumps in accordance with FIG. 2.

On a larger scale, this drawing shows the support 4 resting on covering 5 permitting its bearing on the inner surface of main vessel 8. It is also possible to see how the projection 20 is traversed by envelope 30 surrounding the drive shaft 29 of wheel 26 constituting together the removable part of pump 18.

According to the invention, the non-removable part, constituted by suction channel 25, diffuser 27 and the delivery pipe or pipes 28 is no longer carried by covering 5, but is suspended on a rigid supporting structure formed by two beams 33 (only one of which can be seen in the drawing), fixed by their lower ends 34 to covering 5 and having at the other end thereof a curved portion 35. Suction channel 25 has at its open end a circular projection 36 fixed to each of the beams by means of a series of parallel metal sheets or plates 37 fitted between two connecting members 38, 39 provided on beam 33 on the one hand and on projection 36 on the other.

This disposition makes it possible to on the one hand eliminate in region 24 an obstacle to the flow of sodium between the outlet of the exchangers and the intake into each channel 25 and on the other to chock the centrifugal wheel 26 at a height such that cavitation risks are reduced. It should also be noted that the use of thin metal plates or sheets 37 for ensuring the suspension of the nonremovable assembly relative to the supporting covering of the core permits a radial displacement of said assembly in a direction parallel to the plane of plates 37, whilst in the direction perpendicular to the above-mentioned direction the rigidity of said assembly is ensured by the presence of the delivery pipes 28 which extend between diffuser 27 and support 4.

The invention is not limited to the embodiments described and represented hereinbefore and various modifications can be made thereto without passing beyond the scope of the invention.

What we claim is:

1. A fast nuclear reactor including a core, a supporting structure for supporting said core, and a vessel containing a liquid coolant metal, a pump for circulating said liquid metal, said pump being located within said vessel, the improvement comprising, a non-removable assembly portion of said pump, said non-removable assembly including a suction channel, a diffuser, and at least one delivery pipe, said non-removable assembly being attached to said supporting structure by means of at least two curved beams each fixed at one of its ends to the said supporting structure and each connected at its other end to the first ends of a plurality of parallel, separate metallic sheets, the second ends of said metallic sheets being connected to said non-removable assembly, whereby a radial displacement of the non-removable assembly portion of the pump is made possible.

2. The fast nuclear reactor of claim 1 including a delivery pipe leading from and fixed to said diffuser, said delivery pipe leading to said core.

* * * * *